US009239541B2

(12) United States Patent
Shimizu et al.

(10) Patent No.: US 9,239,541 B2
(45) Date of Patent: Jan. 19, 2016

(54) IMAGE FORMING APPARATUS

(71) Applicant: KYOCERA Document Solutions Inc., Osaka-shi (JP)

(72) Inventors: Tamotsu Shimizu, Osaka (JP); Akihiro Watanabe, Osaka (JP); Akira Matayoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/713,799

(22) Filed: May 15, 2015

(65) Prior Publication Data

US 2015/0331354 A1 Nov. 19, 2015

(30) Foreign Application Priority Data

May 19, 2014 (JP) ..... 2014-103170

(51) Int. Cl.
*G03G 15/08* (2006.01)

(52) U.S. Cl.
CPC ..... *G03G 15/0822* (2013.01); *G03G 15/0812* (2013.01); *G03G 15/0813* (2013.01)

(58) Field of Classification Search
CPC ..... G03G 15/0812; G03G 15/0813; G03G 15/0822
See application file for complete search history.

(56) References Cited

U.S. PATENT DOCUMENTS 5,610,690 A * 3/1997 Yoshihara ..... G03G 5/14726 399/111
6,296,704 B1 * 10/2001 Yamazaki ..... B05C 3/09 118/423
6,314,263 B1 * 11/2001 Yoshida ..... G03G 15/0818 399/286
8,112,020 B2 2/2012 Mabuchi et al.
2002/0150832 A1 * 10/2002 Kinoshita ..... B05C 3/09 430/133
2008/0003513 A1 * 1/2008 Yanus ..... G03G 5/0571 430/58.05
2009/0311012 A1 12/2009 Mabuchi et al.

FOREIGN PATENT DOCUMENTS

JP 2009-300677 A 12/2009

* cited by examiner

*Primary Examiner* — G. M. Hyder
(74) *Attorney, Agent, or Firm* — Studebaker & Brackett PC

(57) ABSTRACT

A photosensitive drum is axially rotatable and has a surface on which an electrostatic latent image is formed. A developing device includes a development roller spaced from the photosensitive drum. The development roller includes a cylindrical sleeve and a coating layer, and the photosensitive drum includes a cylindrical tube and a functional layer. Each of the coating layer and functional layer is formed by dipping the sleeve or tube into a dipping bath with the sleeve or tube directed axially vertically. An axial end portion of the development roller that is lower during the dipping process is disposed opposite to an axial end portion of the photosensitive drum that is higher during the dipping process, and an axial end portion of the development roller that is higher during the dipping process is disposed opposite to an axial end portion of the photosensitive drum that is lower during the dipping process.

6 Claims, 4 Drawing Sheets

IMAGE FORMING APPARATUS

INCORPORATION BY REFERENCE

The present application claims priority under 35 U.S.C. §119 to Japanese Patent Application No. 2014-103170, filed May 19, 2014. The contents of this application are incorporated herein by reference in their entirety.

BACKGROUND

The present disclosure relates to image forming apparatuses for forming an image on a sheet.

An electrographic image forming apparatus includes a photosensitive drum on which an electrostatic latent image is formed and a developing device that develops the electrostatic latent image by supplying toner to the electrostatic latent image. As a result, a toner image is formed on the photosensitive drum. The image forming apparatus may for example be a copier, printer, or facsimile machine. The developing device includes a housing and a development roller (toner bearing member) that is rotatably supported in the housing. The development roller is spaced by a predetermined gap from the photosensitive drum. The development roller carries a toner-containing developer on its peripheral surface. In one example, the development roller is disposed opposite to the photosensitive drum. The development roller is manufactured by an immersion method (dip method or dipping process). More specifically, a tube being an element for forming a development roller is dipped into a resin liquid in which a resin material is dissolved in advance, such that the development roller has a surface coated with a resin layer.

SUMMARY

An image forming apparatus according to a first aspect of the present disclosure includes an image bearing member and a developing device. The image bearing member is axially rotatable and has a surface on which an electrostatic latent image is formed. The developing device is disposed opposite to the image bearing member. The developing device includes a housing and a developer bearing member. The developer bearing member is spaced from the image bearing member and supported in the housing so as to be axially rotatable, the developer bearing member having a surface for carrying developer thereon. The developer bearing member includes a first base having a cylindrical shape and a first surface layer disposed over the first base. The image bearing member includes a second base having a cylindrical shape and a second surface layer disposed over the second base. The first surface layer is formed through a dipping process of dipping the first base into a dipping bath with the first base directed axially vertically, and the second surface layer is formed through a dipping process of dipping the second base into a dipping bath with the second base directed axially vertically. The image bearing member and the developer bearing member are disposed such that an axial end portion of the developer bearing member that is lower during the dipping process is opposite to an axial end portion of the image bearing member that is higher during the dipping process, and that an axial end portion of the developer bearing member that is higher during the dipping process is opposite to an axial end portion of the image bearing member that is lower during the dipping process.

DETAILED DESCRIPTION

With reference to the accompanying drawings, the following describes an image forming apparatus according to an embodiment of the present disclosure in detail. The embodiment described below is not intended to limit the scope of the claims. In addition, not all components mentioned in the description of the embodiment are essential to solutions provided by the present disclosure. Throughout the drawings, the same or corresponding components are denoted by the same reference signs. The image forming apparatus according to the embodiment of the present disclosure is an electrographic image forming apparatus. The image forming apparatus is a copier, printer, or facsimile machine, for example. The image forming apparatus may be a multifunction peripheral combining the functions of a copier, printer, and/or facsimile machine.

Figure 1:
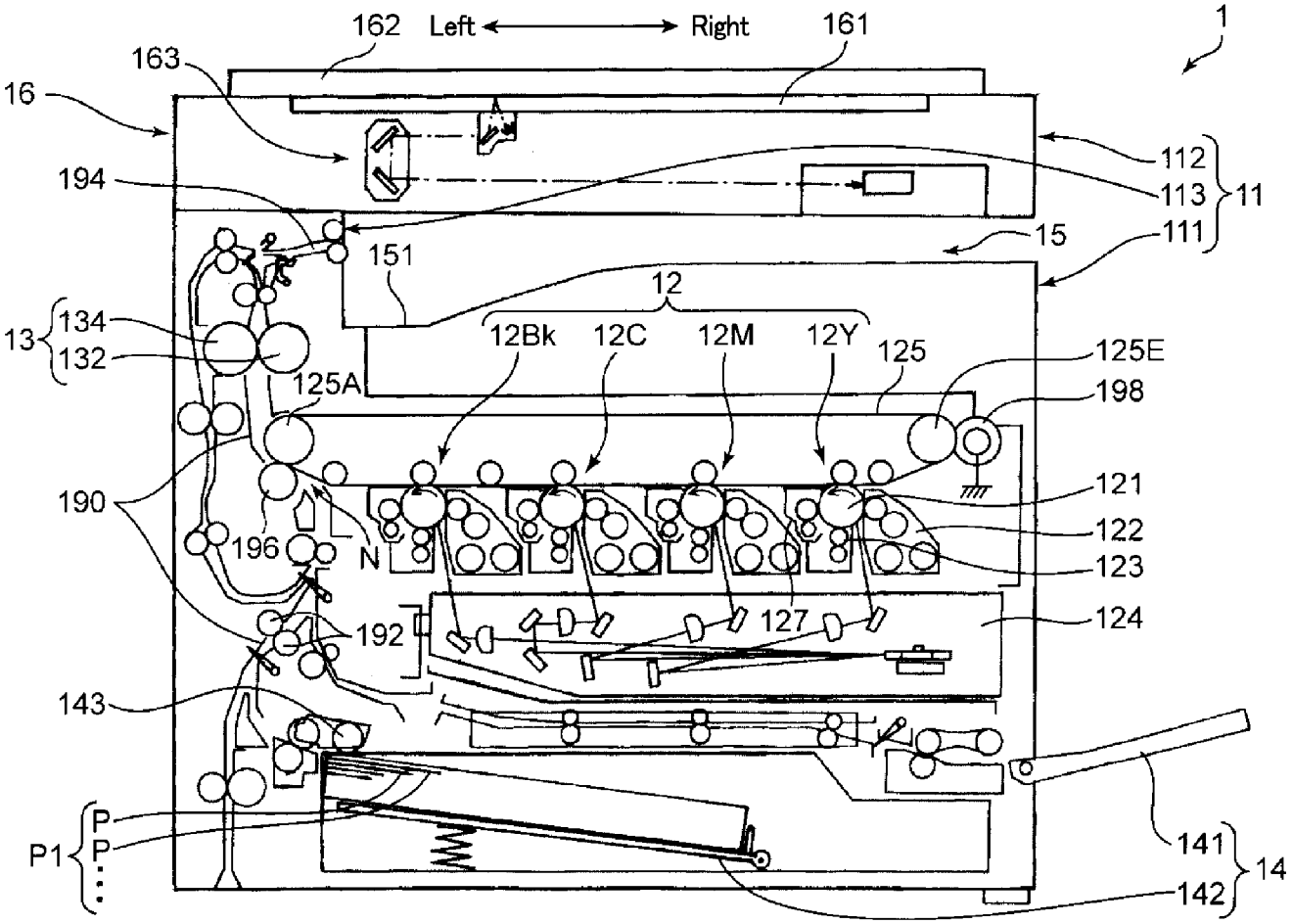
FIG. 1 is a cross-sectional view showing the internal structure of an image forming apparatus according to an embodiment of the present disclosure.

FIG. 1 is a front cross-sectional view showing the structure of an image forming apparatus 1 according to the embodiment of the present disclosure. The image forming apparatus 1 includes a main body 11, an image forming section 12, a fixing device 13, a paper feed section 14, a paper discharging section 15, and a document reading section 16.

The main body 11 includes a lower body 111, an upper body 112, and a connecting portion 113. The upper body 112 is located above the lower body 111. The connecting portion 113 is located between the upper body 112 and the lower body 111, connecting the lower body 111 and the upper body 112 with the paper discharging section 15 provided in a space therebetween. The connecting portion 113 defines an L-shape in plan view along left and rear portions of the lower body 111 and projects upward from the lower body 111. The upper body 112 is supported on the top of the connecting portion 113.

The image forming section 12, the fixing device 13, and the paper feed section 14 are housed in the lower body 111. The document reading section 16 is mounted in the upper body 112.

The image forming section 12 performs an image forming operation on a sheet of paper P fed from the paper feed section 14. The term "image forming operation" refers to an operation for forming a toner image on a sheet P. The image forming section 12 includes a unit 12Y for yellow, a unit 12M for magenta, a unit 12C for cyan, a unit 12Bk for black, an intermediate transfer belt 125, a secondary transfer roller 196, and a belt cleaning device 198. The units 12Y, 12M, 12C, and 12Bk are located in the stated order horizontally from upstream to downstream in terms of paper conveyance. The unit 12Y for yellow uses yellow toner. The unit 12M for magenta uses magenta toner. The unit 12C for cyan uses cyan toner. The unit 12Bk for black uses black toner. The intermediate transfer belt 125 is an endless belt stretched around a plurality of rollers, including a drive roller 125A, and circulates in a sub-scanning direction in an image formation process. The secondary transfer roller 196 is in contact with the outer circumferential surface of the intermediate transfer belt 125.

The units 12Y, 12M, 12C, and 12Bk of the image forming section 12 each include a photosensitive drum 121 (image bearing member), a developing device 122, a toner cartridge (not shown) containing toner, a charger 123, and a drum cleaning device 127. Each developing device 122 supplies toner (developer) to the corresponding photosensitive drum 121. An exposure device 124 is disposed below the developing devices 122 so as to extend horizontally and exposes the photosensitive drums 121 to light.

Each photosensitive drum 121 has a cylindrical shape and is axially rotatable. An electrostatic latent image is formed on the peripheral surface (surface) of a photosensitive drum 121 and developed into a toner image with toner supplied thereto. The photosensitive drum 121 carries the resulting toner image. According to the present embodiment, each photosensitive drum 121 is an organic photoconductor (OPC). The photosensitive drum 121 has a surface coated with one or more functional layers such as a charge generating layer and a charge transport layer.

The photosensitive drum 121 rotates in a direction indicated by an arrow in the drawings. The developing device 122 supplies toner to an electrostatic latent image formed on the peripheral surface of the photosensitive drum 121, causing the toner to accumulate on the electrostatic latent image. As a result, a toner image conforming to the electrostatic latent image is formed on the peripheral surface of the photosensitive drum 121. Each developing device 122 is appropriately replenished with toner from the corresponding toner cartridge.

The chargers 123 are located directly under the respective photosensitive drums 121. Each charger 123 uniformly charges the peripheral surface of the corresponding photosensitive drum 121.

The exposure device 124 is located below the chargers 123. The exposure device 124 scans a laser beam across the charged surface of each photosensitive drum 121 based on image data for a corresponding color. As a result, an electrostatic latent image is formed on the peripheral surface of each photosensitive drum 121. The image data may for example be data input from a computer or the like or data acquired by the document reading section 16. The exposure device 124 emits a laser beam to provide a predetermined amount of exposure to each photosensitive drum 121 in order to form a latent image at a predetermined potential. Each drum cleaning device 127 is located to the left of the corresponding photosensitive drum 121. The drum cleaning device 127 cleans the photosensitive drum 121 by removing residual toner from the peripheral surface of the photosensitive drum 121.

The intermediate transfer belt 125 is a flexible and conductive endless belt. The intermediate transfer belt 125 has a multi-layered structure including a base layer, an elastic layer, and a coating layer. The intermediate transfer belt 125 is stretched around a plurality of rollers that are aligned substantially horizontally above the image forming section 12. The plurality of rollers include the drive roller 125A and a driven roller 125E. The drive roller 125A is located near the fixing device 13 and drives the intermediate transfer belt 125 to rotate. The driven roller 125E is horizontally spaced by a predetermined gap from the drive roller 125A and passively rotates. Upon receipt of rotational drive force, the drive roller 125A rotates the intermediate transfer belt 125 clockwise as indicated in FIG. 1.

The secondary transfer roller 196 is electrically connected to a secondary-transfer-bias application section (not shown). In response to a transfer bias applied between the secondary transfer roller 196 and the drive roller 125A, a toner image formed on the intermediate transfer belt 125 is transferred to a sheet P conveyed from a pair of conveyance rollers 192 located at a position lower than the intermediate transfer belt 125. The belt cleaning device 198 is located opposite to the driven roller 125E with the intermediate transfer belt 125 therebetween.

The fixing device 13 includes a heating roller 132 and a pressure roller 134. The heating roller 132 is internally provided with a conductive heating element, such as a halogen lamp, as a heat source. The pressure roller 134 is located opposite to the heating roller 132. The fixing device 13 performs a fixing process to fix a toner image transferred to the sheet P by the image forming section 12. More specifically, the fixing device 13 performs the fixing process by applying heat to the sheet P through the heating roller 132 as the sheet P passes through a nip formed between the heating roller 132 and the pressure roller 134. The fixing process completes color printing of the sheet P. After the fixing process, the sheet P is conveyed through a discharge conveyance path 194 to be discharged onto an exit tray 151. The discharge conveyance path 194 extends from the top of the fixing device 13. The exit tray 151 is disposed on the top face of the main body 11.

The paper feed section 14 includes a manual feed tray 141 and a paper feed cassette 142. The manual feed tray 141 is disposed on the right-side wall of the main body 11 shown in FIG. 1 so as to be freely opened and closed. The paper feed cassette 142 is detachably disposed in the main body 11 at a position below the exposure device 124. The paper feed cassette 142 contains a sheet stack P1. The sheet stack P1 is a stack of a plurality of sheets P. A pickup roller 143 is disposed above the paper feed cassette 142. The pickup roller 143 feeds a topmost sheet P from the sheet stack P1 stored in the paper feed cassette 142 into a paper conveyance path 190. The manual feed tray 141 is disposed at a lower portion on the right-side wall of the lower body 111. The manual feed tray 141 is used for manually feeding sheets P to the image forming section 12 one at a time.

The paper conveyance path 190 extends vertically along the left of the image forming section 12. The pair of conveyance rollers 192 is disposed at an appropriate position along the paper conveyance path 190. The pair of conveyance rollers 192 conveys a sheet P fed thereto from the paper feed section 14, toward the secondary transfer nip. The secondary transfer nip is formed between the secondary transfer roller 196 and the drive roller 125A.

The paper discharging section 15 is located between the lower body 111 and the upper body 112. The paper discharging section 15 includes the exit tray 151 formed on the top face of the lower body 111. The exit tray 151 is for receiving a sheet P discharged after a toner image is formed on the sheet P by the image forming section 12 and the fixing process is performed on the sheet P by the fixing device 13.

The document reading section 16 includes contact glass 161, a document holding cover 162, and a scanning mechanism 163. The contact glass 161 is mounted so as to close an opening at the top of the upper body 112. The contact glass 161 is for placing a document thereon. The document holding cover 162 holds a document in place on the contact glass 161. The document holding cover 162 can be freely opened and closed relative to the contact glass 161. The scanning mechanism 163 scans a document placed on the contact glass 161 to read an image of the document. The scanning mechanism 163 includes an image sensor such as a charge coupled device (CCD) or complementary metal oxide semiconductor (CMO). The scanning mechanism generates image data by using the image sensor to optically read a document image. The main body 11 includes an image processing section (not shown). The image processing section uses the image data to generate an image used for printing.

<Structure of Developing Device>

Figure 2:
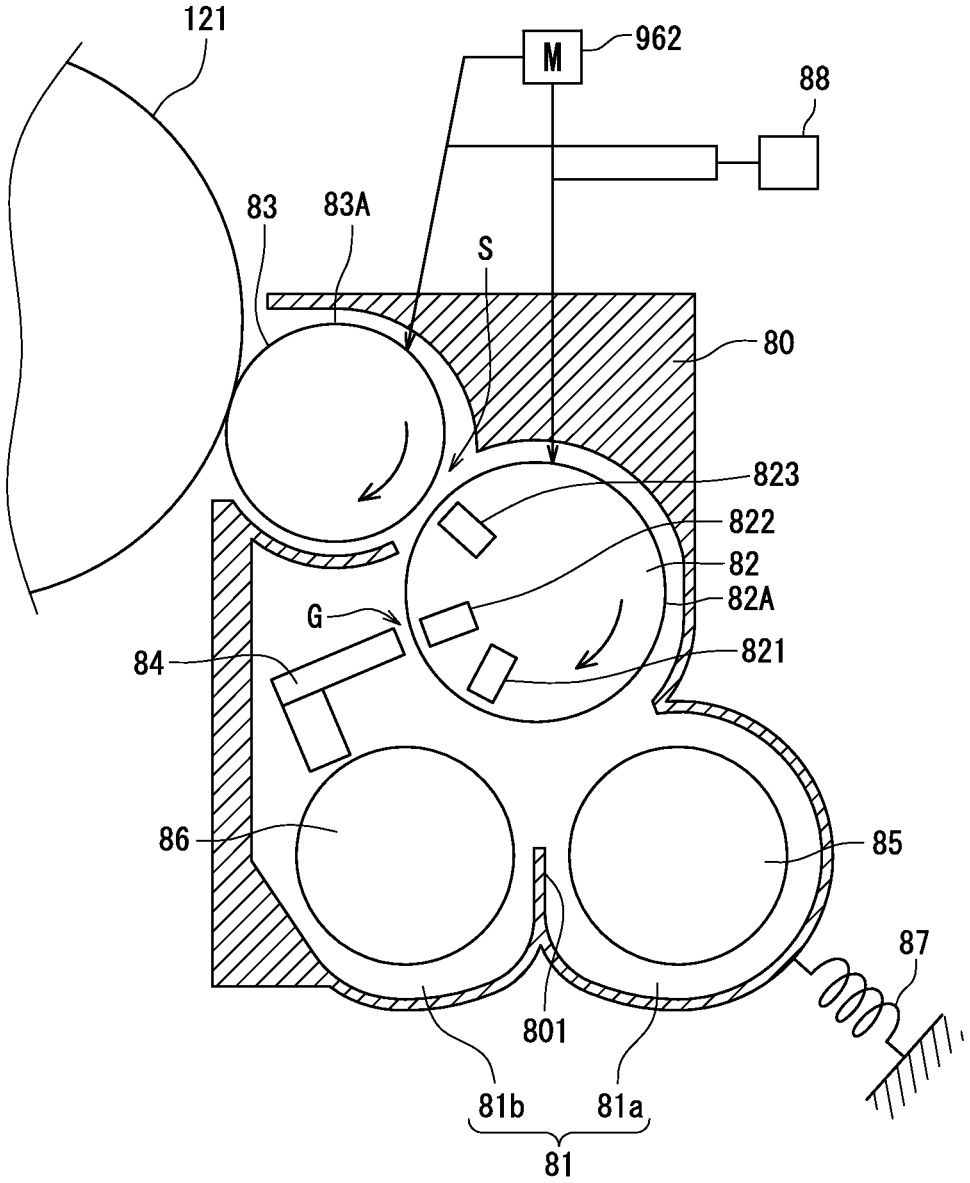
FIG. 2 is a cross-sectional view of a developing device according to the embodiment of the present disclosure.
Figure 3A:
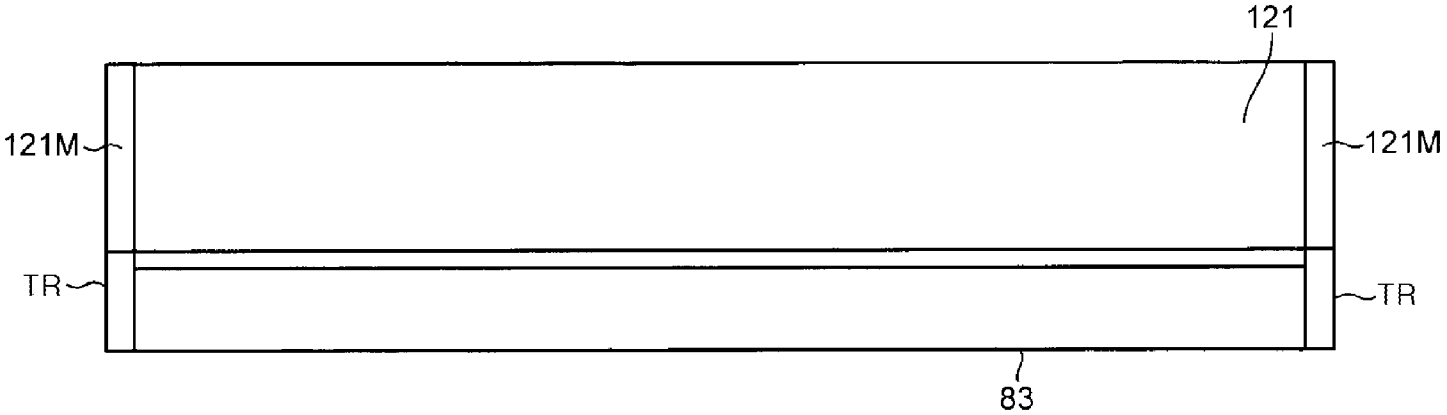
FIG. 3A is a schematic illustration showing the relative axial lengths of an image bearing member and a developer bearing member according to the embodiment of the present disclosure.
Figure 3B:
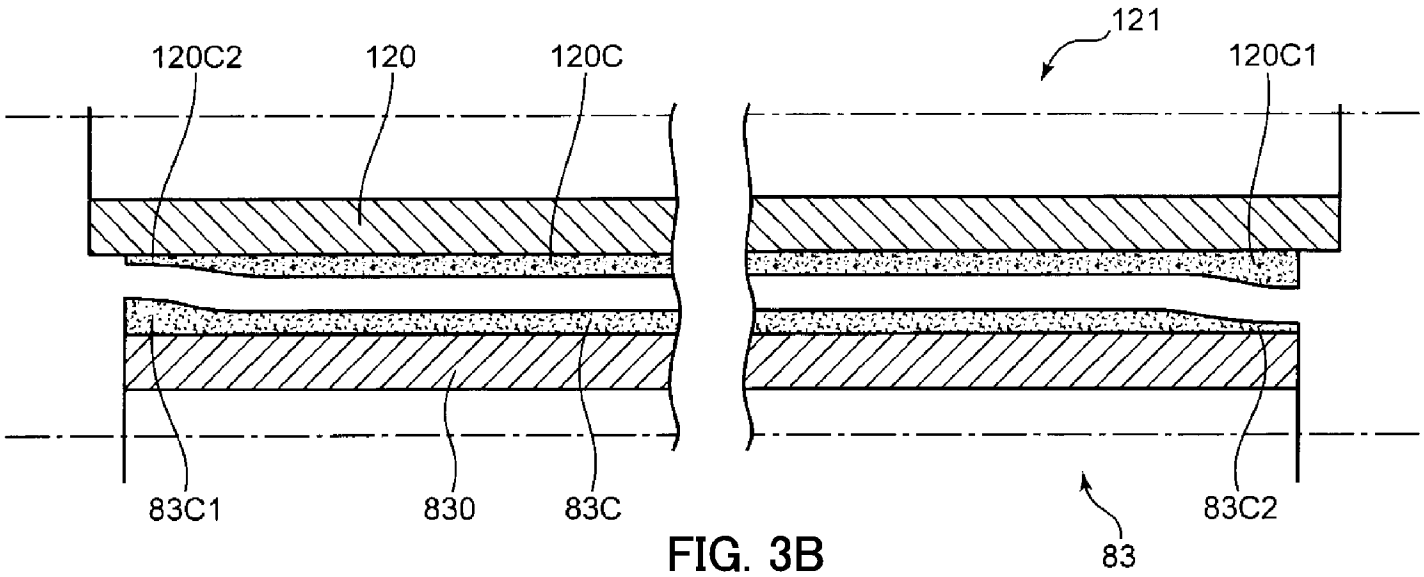
FIG. 3B is a cross-sectional view of the image bearing member and the developer bearing member, schematically illustrating layer thicknesses at axial end portions of each member.

The following describes the developing devices 122 in detail. FIG. 2 is a cross-sectional view schematically showing the internal structure of each developing device 122. FIG. 3A is a schematic view showing the relative axial lengths of a photosensitive drum 121 and a development roller 83 according to the present embodiment. FIG. 3B is a cross-sectional view of the photosensitive drum 121 and the development roller 83, schematically illustrating layer thicknesses at the axial end portions of each of the photosensitive drum 121 and the development roller 83. Each developing device 122 according to the present embodiment employs a touchdown developing method. The developing device 122 includes the development roller 83 and a magnetic roller 82. The developing device 122 is located opposite to the photosensitive drum 121. The developing device 122 includes a developer housing 80 defining the interior space of the developing device 122. The developer housing 80 includes a developer reservoir 81 and contains a non-magnetic toner. The non-magnetic toner charges to a predetermined polarity. The developer reservoir 81 retains therein developer containing magnetic carrier. The developer housing 80 houses the magnetic roller 82, the development roller 83 (developer bearing member), and a developer limiting blade 84. The magnetic roller 82 is located above the developer reservoir 81. The development roller 83 is located opposite to the magnetic roller 82 at a position diagonally above the magnetic roller 82. The developer limiting blade 84 is located opposite to the magnetic roller 82. The developing device 122 includes a driving section 962 and a developing bias applying section 88 (FIG. 2).

As shown in FIG. 2, the developer reservoir 81 includes a first chamber 81*a* and a second chamber 81*b*. The first chamber 81*a* and the second chamber 81*b* each extend in a longitudinal direction of the developing device 122. The first chamber 81*a* and the second chamber 81*b* are adjacent to each other. The first chamber 81*a* and the second chamber 81*b* are partitioned from each other with a partition plate 801. The first chamber 81*a* and the second chamber 81*b* are communicatively connected through connecting portions (not shown) at both ends of the chambers in the longitudinal direction (axial direction). The partition plate 801 is integral with the developer housing 80 and extends in the longitudinal direction of the developing device 122. The first chamber 81*a* includes a first screw feeder 85, and the second chamber 81*b* includes a second screw feeder 86. The first screw feeder 85 and the second screw feeder 86 each axially rotate to stir and convey developer. The first screw feeder 85 and the second screw feeder 86 are rotationally driven by the driving section 962. The first screw feeder 85 and the second screw feeder 86 are set to rotate in mutually opposite directions. This configuration ensures that the developer is stirred while circulating through the first chamber 81*a* and the second chamber 81*b*. Through the stirring, the toner and the carrier are mixed. As a result, the toner is for example charged to a positive polarity.

The magnetic roller 82 extends in the longitudinal direction of the developing device 122. The magnetic roller 82 is rotatably supported in the developer housing 80 at a position opposite to the development roller 83. The magnetic roller 82 is driven to rotate clockwise as indicated in FIG. 2. The magnetic roller 82 is provided with a fixed magnet roll (fixed magnet, not shown) in its interior. The magnet roll has a plurality of magnetic poles. According to the present embodiment, the magnet roll has a pump pole 821, a limiting pole 822, and a main pole 823. The pump pole 821 is located opposite to the developer reservoir 81, the limiting pole 822 is located opposite to the developer limiting blade 84, and the main pole 823 is located opposite to the development roller 83.

By the magnetic force of the pump pole 821, the magnetic roller 82 magnetically pumps up (receives) the developer from the developer reservoir 81 onto a circumferential surface 82A thereof. The magnetic roller 82 then carries developer drawn thereto as a layer (magnetic brush layer) on the circumferential surface 82A. The magnetic roller 82 supplies toner to the development roller 83. As the magnetic roller 82 rotates, the developer is conveyed toward the developer limiting blade 84.

The developer limiting blade 84 is opposite to the magnetic roller 82 at a position upstream from the development roller 83 in terms of the rotation direction of the magnetic roller 82 with the pump pole 821 taken as a starting point. The developer limiting blade 84 limits the layer thickness of the developer adhering by magnetic force to the circumferential surface 82A of the magnetic roller 82. The developer limiting blade 84 is spaced by a limiting gap G of a predetermined size from the circumferential surface 82A of the magnetic roller 82. This ensures that a developer layer is formed to a uniform predetermined thickness on the circumferential surface 82A.

The development roller 83 is oriented longitudinally of the developing device 122 and in parallel to the magnetic roller 82. The development roller 83 is driven to rotate clockwise as indicated in FIG. 2. The development roller 83 is spaced from the photosensitive drum 121. The development roller 83 has a cylindrical shape. The development roller 83 is supported in the developer housing 80 so as to be axially rotatable. The development roller 83 has a circumferential surface 83A. The development roller 83 rotates while in contact with the developer layer carried on the circumferential surface 82A of the magnetic roller 82. During the rotation, the development roller 83 receives toner from the developer layer and carries the toner as a layer on the circumferential surface 83A thereof. In the developing process, the development roller 83 supplies toner from the toner layer to the circumferential surface of the corresponding photosensitive drum 121.

The development roller 83, the magnetic roller 82, the first screw feeder 85, and the second screw feeder 86 are all driven to rotate by the driving section 962. The driving section 962 is a motor that generates a rotational drive force. A gap S (FIG. 2) of a predetermined size is present between the circumferential surface 83A of the development roller 83 and the circumferential surface 82A of the magnetic roller 82. The gap S is for example 0.3 mm. The development roller 83 is disposed to face the photosensitive drum 121 through an opening formed in the developer housing 80. A gap of a predetermined size is present between the circumferential surface 83A of the development roller 83 and the circumferential surface of the photosensitive drum 121. In the present embodiment, the gap is 0.12 mm.

The developing bias applying section 88 applies a developing bias, which is generated by superimposing alternating-current voltage on direct-current voltage, to the magnetic roller 82 and the development roller 83. A high alternating-current voltage is applied between the photosensitive drum 121 and the development roller 83 as well as between the development roller 83 and the magnetic roller 82. According to the present embodiment, toner is supplied from the magnetic roller 82 to the development roller 83 and subsequently from the development roller 83 to the photosensitive drum 121. Therefore, in comparison to commonly known developing devices, the developing bias applying section 88 according to the present embodiment applies a relatively high alternating-current voltage to the development roller 83 for causing toner transfer.

According to the present embodiment, the axial length of the photosensitive drum 121 is slightly longer than the axial length of the development roller 83 as shown in FIG. 3A. Each developing device 122 additionally includes a pair of tracking rollers TR (limiting members) and a biasing spring (elastic member) 87. The tracking rollers TR are axially supported on the respective axial end portions of the development roller 83. The tracking rollers TR abut against the photosensitive drum 121 at the respective axial end portions thereof to regulate the gap between the development roller 83 and the photosensitive drum 121. The developer housing 80 is biased toward the photosensitive drum 121 by the biasing spring 87. Consequently, the gap between the development roller 83 and the photosensitive drum 121 is stably maintained.

The development roller 83 includes a cylindrical sleeve 830 (first base) and a coating layer 83C (first surface layer) formed over the sleeve 830 (FIG. 3B). The photosensitive drum 121 includes a cylindrical tube 120 (second base) and a functional layer 120C (second surface layer) formed over the cylindrical tube 120. The photosensitive drum 121 has exposed portions 121M at positions axially outward from the functional layer 120C, i.e., at the respective axial end portions. The exposed portions 121M are portions of the cylindrical tube 120 exposed by partially removing the functional layer 120C.

The sleeve 830 of the development roller 83 is made of aluminum. The coating layer 83C of the development roller 83 is formed through a dipping process described below. First, the outer circumferential surface of the sleeve 830 is anodized. As a result, an anodized layer (first oxide layer) having a thickness of 10 μm is formed at the surface of the sleeve 830. The presence of an oxide layer (anodized layer) on the aluminum sleeve 830 increases the bonding strength of the coating layer 83C to the sleeve 830. As a result, detachment of the coating layer 83C from the sleeve 830 is restricted. After the anodization, the surface of the sleeve 830, that is, the surface of the anodized layer, is subjected to heat treatment at 120° C. for 10 minutes or longer. The heat treatment for example involves heating of the sleeve 830. The heat treatment is conducted to intentionally cause cracking in the sleeve 830 in advance. Therefore, the heat treatment is caused until, for example, cracking occurs in the surface of the sleeve 830. Consequently, occurrence of cracking is restricted during the process of drying the coating layer 83C. The duration of the heat treatment is determined in advance. For example, the duration of the heat treatment is determined to be equal to or longer than the time taken for the drying process. The heat treatment is always conducted at the same temperature and for the same duration. This ensures that all sleeves 830 subjected to the heat treatment will have approximately the same amount of cracking. Subsequently to the heat treatment described above, a process of forming the coating layer 83C on the anodized layer is conducted. More specifically, an alcohol-soluble nylon resin as a binder resin, titanium oxide as a conducting material, and 800 parts by weight of methanol as a dispersion medium are mixed with zirconia beads measuring 1.0 mm in diameter to prepare a liquid mixture (dipping bath). The mixing is carried out for about 48 hours using a ball mill. The anodized sleeve 830 is dipped into the liquid mixture, raised out of the liquid mixture after a predetermined period, and then dried in a high temperature environment of 130° C. for 10 minutes. The sleeve 830 is dipped into and raised out of the liquid mixture with the cylindrical sleeve 830 directed axially vertically. As a result, the coating layer 83C is coated onto the sleeve 830 with a thickness ranging from 2 μm to 11 μm along the axial length of the sleeve 830. As described above, the anodized layer is heat-treated in advance to cause cracking before the coating layer 83C is formed. This heat-treatment effectively prevents the conducting material contained in the coating layer 83C from being unevenly distributed due to convection within the coating layer 83C during the drying of the coating layer 83C. Consequently, the resultant coating layer 83C is ensured to have the conductive material uniformly dispersed therein.

The functional layer 120C of each photosensitive drum 121 is formed through a dipping process in the same manner as the coating layer 83C described above. The functional layer 120C includes a charge generating layer and a charge transport layer. The charge generating layer and the charge transport layer have a function of forming an electrostatic latent image over the surface of the photosensitive drum 121. An anodized layer (second oxide layer) is also formed at the surface of the aluminum cylindrical tube 120 prior to forming the functional layer 120C. Then, the functional layer 120C is formed on the anodized layer.

When the coating layer 83C and the functional layer 120C are each formed through the dipping process as described above, the following should be noted. That is, when the sleeve 830 or the cylindrical tube 120 is raised out of the liquid mixture, the liquid mixture adhering to the surface thereof tends to flow downward under the influence of gravity. As a consequence, the coating layer 83C formed on the surface of the sleeve 830 has an increased-thickness portion 83C1 on an axial end portion of the sleeve 830 that is lower during the dipping. The coating layer 83C is thicker at the increased-thickness portion 83C1 than at a portion corresponding to the axial center of the sleeve 830. In addition, the coating layer 83C has a reduced-thickness portion 83C2 on an axial end portion of the sleeve 830 that is higher during the dipping. The coating layer 83C is thinner at the reduced-thickness portion 83C2 than at the portion corresponding to the axial center of the sleeve 830. Similarly, the functional layer 120C formed on the cylindrical tube 120 has an increased-thickness portion 120C1 on an axial end portion of the cylindrical tube 120 that is lower during the dipping. The functional layer 120C is thicker at the increased-thickness portion 120C1 than at a portion corresponding to the axial center of the cylindrical tube 120. In addition, the functional layer 120C has a reduced-thickness portion 120C2 on an axial end portion of the cylindrical tube 120 that is higher during the dipping. The functional layer 120C is thinner at the reduced-thickness portion 120C2 than at the portion corresponding to the axial center of the cylindrical tube 120.

The axial length of the reduced-thickness portion 83C2 tends to be longer than the axial length of the increased-thickness portion 83C1 due to the influence of gravity while the sleeve 830 is being drawn up. Similarly, the axial length of the reduced-thickness portion 120C2 tends to be longer than the axial length of the increased-thickness portion 120C1.

According to the present embodiment, each photosensitive drum 121 and the corresponding developing device 122 are disposed such that the axial end portion of the development roller 83 that is lower during the dipping is opposite to the axial end portion of the photosensitive drum 121 that is higher during the dipping and that the axial end portion of the development roller 83 that is higher during the dipping is opposite to the axial end portion of the photosensitive drum 121 that is lower during the dipping. That is, the increased-thickness portion 83C1 of the development roller 83 is opposite to the reduced-thickness portion 120C2 of the photosensitive drum 121, whereas the increased-thickness portion 120C1 of the photosensitive drum 121 is opposite to the reduced-thickness portion 83C2 of the development roller 83. This arrangement reduces variation in the gap between the development roller 83 and the photosensitive drum 121 along the axial direction. As a result, leakage of current is prevented, which tends to occur when there is a localized narrowing of the gap. In addition, reduction in image density is prevented, which tends to occur due to weakening of the electric field applied during the developing process when there is a localized widening of the gap.

Figure 4:
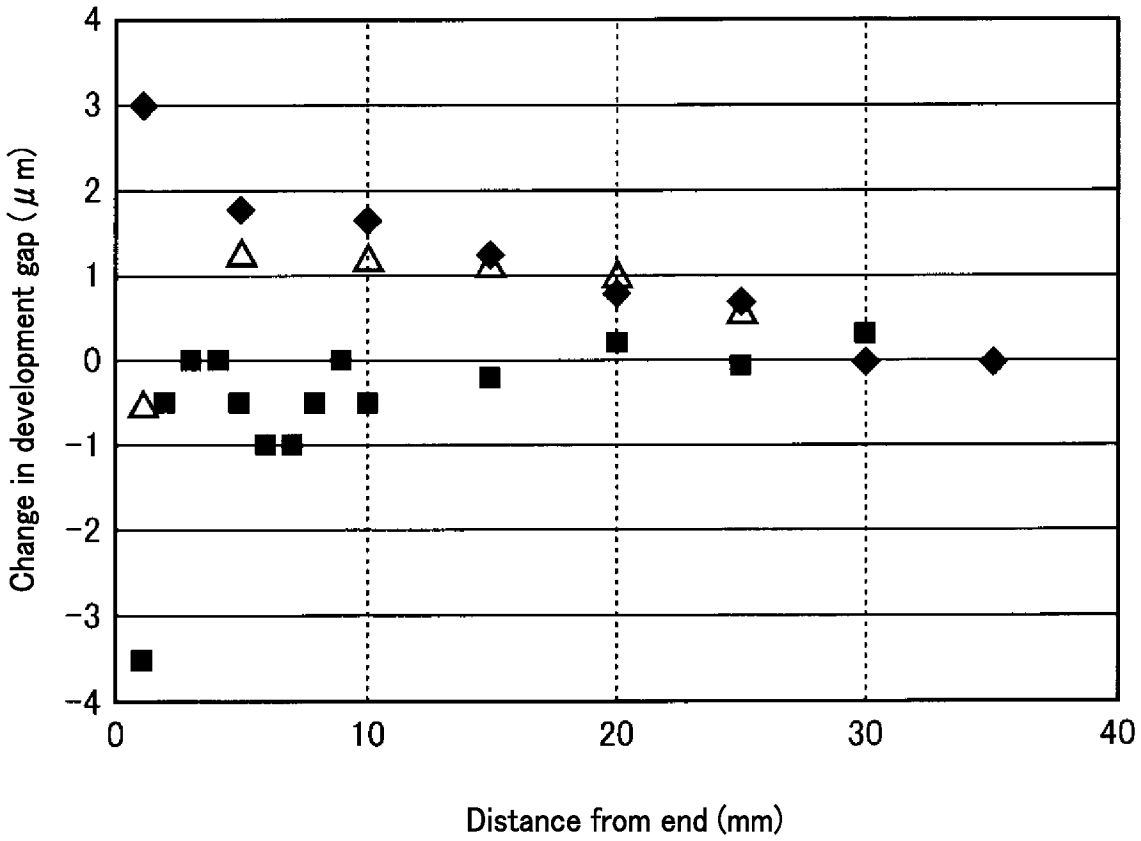
FIG. 4 is a graph indicating the layer thicknesses of each of the image bearing member and the developer bearing member according to the embodiment of the present disclosure at an axial end portion thereof.

FIG. 4 is a graph indicating the layer thickness distribution of each of the photosensitive drum 121 and the development roller 83 at one axial end portion thereof. More specifically, FIG. 4 shows the layer thickness distribution of the reduced-thickness portion 120C2 of the photosensitive drum 121 and the increased-thickness portion 83C1 of the development roller 83. In FIG. 4, the horizontal axis of the graph represents the distance from the end face of the photosensitive drum 121. The vertical axis of the graph represents a change (increase or decrease) in the gap between the reduced-thickness portion 120C2 and the increased-thickness portion 83C1 with respect to an average size of the gap (development gap) between the development roller 83 and the photosensitive drum 121. In the graph, the black diamonds each indicate a change (increase or decrease) in the gap attributable to the thickness of the reduced-thickness portion 120C2, relative to a portion where the gap is of average size. The black squares each indicate a change (increase or decrease) in the gap attributable to the thickness of the increased-thickness portion 83C1, relative to a portion where the gap is of average size. The white triangles each indicate an overall change (increase or decrease) in the gap due to a combination of the reduced-thickness portion 120C2 and the increased-thickness portion 83C1, relative to the average size of the development gap.

In FIG. 4, when the reduced-thickness portion 120C2 of the photosensitive drum 121 is considered alone, the development gap is wider because the functional layer 120C is thinner. On the other hand, when the increased-thickness portion 83C1 of the development roller 83 is considered alone, the development gap is narrower because the coating layer 83C is thicker. According to the present embodiment, the reduced-thickness portion 120C2 of the photosensitive drum 121 is disposed opposite to the increased-thickness portion 83C1 of the development roller 83. Therefore, when considering the reduced-thickness portion 120C2 and the increased-thickness portion 83C 1 in combination, the difference in the thickness of one of the functional layer 120C and the coating layer 83C compensates for the difference in the thickness of the other, as indicated by the overall change in the gap. As a result, variation in the width of the development gap is reduced. The same advantage is achieved with respect to the other axial end portions of the photosensitive drum 121 and the development roller 83, i.e., with respect to a combination of the increased-thickness portion 120C1 of the photosensitive drum 121 and the reduced-thickness portion 83C2 of the development roller 83. As has been described above, the photosensitive drum 121 and the development roller 83 are disposed such that the axial end portion of the one of the photosensitive drum 121 and the development roller 83 that is higher during the dipping is located opposite to the axial end portion of the other of the photosensitive drum 121 and the development roller 83 that is lower during the dipping. This arrangement is effective for forming a developing nip in a manner that reduces the influence of variation in the thickness of the functional layer 120C of the photosensitive drum 121 and the coating layer 83C of the development roller 83, which are each formed though a dipping process.

Furthermore, in the same way as the development roller 83, the photosensitive drum 121 according to the present embodiment has an anodized layer (oxide layer) on the aluminum cylindrical tube 120 and the functional layer 120C formed on the anodized layer through a dipping process. Each anodized layer is formed to have surface asperities at a predetermined scale. The presence of the surface asperities helps to slow the liquid mixture running downward when the development roller 83 or the cylindrical tube 120 is raised out of the dipping bath. As a result, the coating layer 83C and the functional layer 120C, which are each formed through a dipping process, will have a similar thickness distribution with respect to a reduced-thickness portion and an increased-thickness portion in the axial direction. Therefore, the gap between the development roller 83 and the photosensitive drum 121 will have a more uniform width throughout the axial direction. This advantage is specifically notable when the photosensitive drum 121 is an OPC drum having a single layer structure. This is because the functional layer 120C, which is the only layer, tends to conform more precisely to the surface profile of the cylindrical tube 120.

According to the present embodiment, the coating layer 83C and the functional layer 120C are each formed through a dipping process, which achieves the following advantages as compared with when such layers are formed by spraying. First, the layers formed by spraying tend to have surface asperities resulting from sprayed droplets. Such surface asperities tend to be worn away with use. That is, although a development roller having such a layer experiences an initial increase in toner conveyance performance, the toner conveyance performance tends to decrease with time. As a result, developing functionality deteriorates, leading to decreased image density. On the other hand, the coating layer 83C according to the present embodiment is formed through a dipping process and thus has fine surface asperities. Such fine surface asperities are more resistant to wear than surface asperities formed by spraying. Consequently, the development roller 83 can maintain stable toner conveyance performance over a long time. Second, forming a coating layer and a functional layer by spraying tends to result in dust and dirt in the air becoming adhered to the coating layer and the functional layer during the production. In contrast, forming the respective layers through a dipping process is less likely to suffer from such problems. Third, a dipping process enables easier control of layer thickness than a spraying method.

As illustrated in FIG. 3B, the gap between the photosensitive drum 121 and the development roller 83 is made more uniform along the axial direction, which achieves the following effects. As the development roller 83 and the photosensitive drum 121 rotate, laminar flow of toner occurs between the development roller 83 and the photosensitive drum 121. A turbulent flow is likely to occur where there is localized narrowing or widening of the gap between the development roller 83 and the photosensitive drum 121. This tends to result in toner scattering within the image forming apparatus 1. As has been described above, the photosensitive drum 121 and the development roller 83 are disposed such that the axial end portion of one of the photosensitive drum 121 and the development roller 83 that is higher during the dipping is located opposite to the axial end portion of the other of the photosensitive drum 121 and the development roller 83 that is lower during the dipping, and vice versa. This arrangement is effective to restrict toner scattering.

In addition, an overcurrent tends to flow in partially projected portions, such as the increased-thickness portion 120C1 of the photosensitive drum 121 and the increased-thickness portion 83C1 of the development roller 83. This may increase the possibility that the coating layer 83C or the functional layer 120C suffers from leak current or deterioration. This may result in detachment of the coating layer 83C from the development roller 83 or of the functional layer 120C from the photosensitive drum 121 at their axial end portions. However, according to the present embodiment, the increased-thickness portion 120C1 is located opposite to the reduced-thickness portion 83C2, whereas the increased-thickness portion 83C1 is located opposite to the reduced-thickness portion 120C2. This arrangement restricts localized strengthening of the electric field applied for the developing process to be partially stronger. Consequently, detachment of the coating layer 83C or the functional layer 120C is prevented.

Up to this point, the developing device 122 and the image forming apparatus 1 according to the embodiment of the present disclosure has been described. However, the present disclosure is not limited to the specific embodiment and various modified embodiments including the following may be made.

(1) In the embodiment given above, the image forming apparatus 1 is described as being a full-color image forming apparatus, which should not be construed as a limitation. The image forming apparatus 1 may be a monochrome printer that produces monochrome images. The developing device 122 is not limited to one employing a touchdown development method. The developing device 122 may employ a method using either a magnetic or non-magnetic one-component developer.

(2) The embodiment given above is directed to implementation with the sleeve 830 and the cylindrical tube 120 each having an oxide layer at the surface, which should not be construed as a limitation. The sleeve 830 and the cylindrical tube 120 may be formed with no oxide layer. Alternatively, only one of the photosensitive drum 121 and the development roller 83 may be provided with an oxide layer.

What is claimed is:

1. An image forming apparatus comprising:

an image bearing member that is axially rotatable and has a surface on which an electrostatic latent image is formed; and a developing device disposed opposite to the image bearing member, wherein the developing device includes a housing, and a developer bearing member that is spaced from the image bearing member and supported in the housing so as to be axially rotatable, the developer bearing member having a surface for carrying developer thereon, the developer bearing member includes a first base having a cylindrical shape and a first surface layer disposed over the first base, the image bearing member includes a second base having a cylindrical shape and a second surface layer disposed over the second base, the first surface layer is formed through a dipping process of dipping the first base into a dipping bath with the first base directed axially vertically, and the second surface layer is formed through a dipping process of dipping the second base into a dipping bath with the second base directed axially vertically, and the image bearing member and the developer bearing member are disposed such that an axial end portion of the developer bearing member that is lower during the dipping process is opposite to an axial end portion of the image bearing member that is higher during the dipping process, and an axial end portion of the developer bearing member that is higher during the dipping process is opposite to an axial end portion of the image bearing member that is lower during the dipping process.

2. The image forming apparatus according to claim 1, wherein the first base is made from aluminum, a surface of the first base has a first oxide layer, and the first surface layer is disposed over a surface of the first oxide layer.

3. The image forming apparatus according to claim 1, wherein the second base is made from aluminum, a surface of the second base has a second oxide layer, and the second surface layer is disposed over a surface of the second oxide layer.

4. The image forming apparatus according to claim 1, wherein the developing device further includes a pair of regulating members axially supported on the axial end portions of the developer bearing member, an axial length of the image bearing member is longer than an axial length of the developer bearing member, and the pair of regulating members abuts against the image bearing member at the respective axial end portions thereof.

5. The image forming apparatus according to claim 1, wherein the developing device further includes an elastic member biasing the housing toward the image bearing member.

6. The image forming apparatus according to claim 2, wherein the first oxide layer is heat-treated to cause cracking in the first base.

* * * * *